United States Patent [19]

Townsend

[11] 3,998,250

[45] Dec. 21, 1976

[54] HEDDLE TRANSFER STOP MOTION IN A TRIAXIAL WEAVING MACHINE

[75] Inventor: Franklin L. Townsend, Rockford, Ill.

[73] Assignee: Barber-Colman Company, Rockford, Ill.

[22] Filed: May 3, 1976

[21] Appl. No.: 682,774

[52] U.S. Cl. ..... 139/336; 139/DIG. 1; 139/337

[51] Int. Cl.[2] ..... D03D 51/18

[58] Field of Search ..... 139/DIG. 1, 11, 336, 139/337, 338

[56] References Cited

UNITED STATES PATENTS

| | | | |
|---|---|---|---|
| 1,961,400 | 6/1934 | Spedlove | 139/336 |
| 2,306,303 | 12/1942 | Dacey | 139/336 |
| 2,439,031 | 4/1948 | Wilson | 139/336 |
| 3,135,299 | 6/1964 | Abelsma | 139/336 |
| 3,965,939 | 6/1976 | Kulczycki et al. | 139/DIG. 1 |

*Primary Examiner*—Henry S. Jaudon
*Attorney, Agent, or Firm*—A. Richard Koch

[57] ABSTRACT

In a triaxial weaving machine heddles arranged in opposing rows are shifted in opposite weftwise direction with the leading heddle in each row being transferred to the trailing position in the opposite row. This invention provides means for stopping the weaving process if a heddle being transferred is not, at the end of the transfer operation, aligned with a slot to guide the heddle during a heddle shedding operation.

15 Claims, 8 Drawing Figures

HEDDLE TRANSFER STOP MOTION IN A TRIAXIAL WEAVING MACHINE

BACKGROUND OF THE INVENTION

This invention relates to weaving machines for making triaxial fabrics in which warp strands are guided by heddles and the heddles are transferred from the leading end of one weftwise row of heddles moving laterally in one direction to the adjacent trailing end of another weftwise row of heddles moving laterally in the opposite direction. Such operations are disclosed in copending U.S. Pat. applications Ser. Nos. 603,756, filed Aug. 11, 1975, and 620,332, filed Oct. 7, 1975, both of which are owned in common with the present invention.

The heddles transferred to the trailing end of a weftwise row are received in a retracted shedding position, from which they are advanced to an extended shedding position. In doing so the heddle is moved from a retainer in the transfer mechanism into a passageway by the shedding mechanism. If the retainer and passageway are misaligned when the shedding mechanism tries to move the heddle to extended position, the heddle may be bent or broken, resulting in a jamming or other malfunction of the machine. Such misalignment may result from failure of a heddle to be delivered, incomplete retraction of a heddle shedding mechanism, incomplete motion by the transfer mechanism, improper synchronization of the shedding and transfer mechanisms, component failures, and the like. Due to the complexity of a triaxial weaving machine, removal and replacement of a broken heddle, or clearing of jammed machine components takes a long time and is to be avoided if at all possible.

SUMMARY OF THE INVENTION

According to the present invention a detector at the trailing end of a row of heddles senses the proper alignment, or the misalignment, of the transferred heddle and the passageway. In the event that the heddle is misaligned, the operation of the weaving machine, and more particularly the heddle shedding mechanism, is interrupted to prevent jamming of or damage to the machine and to prevent defects in the fabric being woven. The time and effort saved by detecting misalignment and stopping the machine before damage can be done is well worth the cost of the additional components.

DESCRIPTION OF THE PREFERRED EMBODIMENT

The embodiment described is illustrative of an embodiment of the invention and not as a limitation on the scope of the invention.

Figure 1:
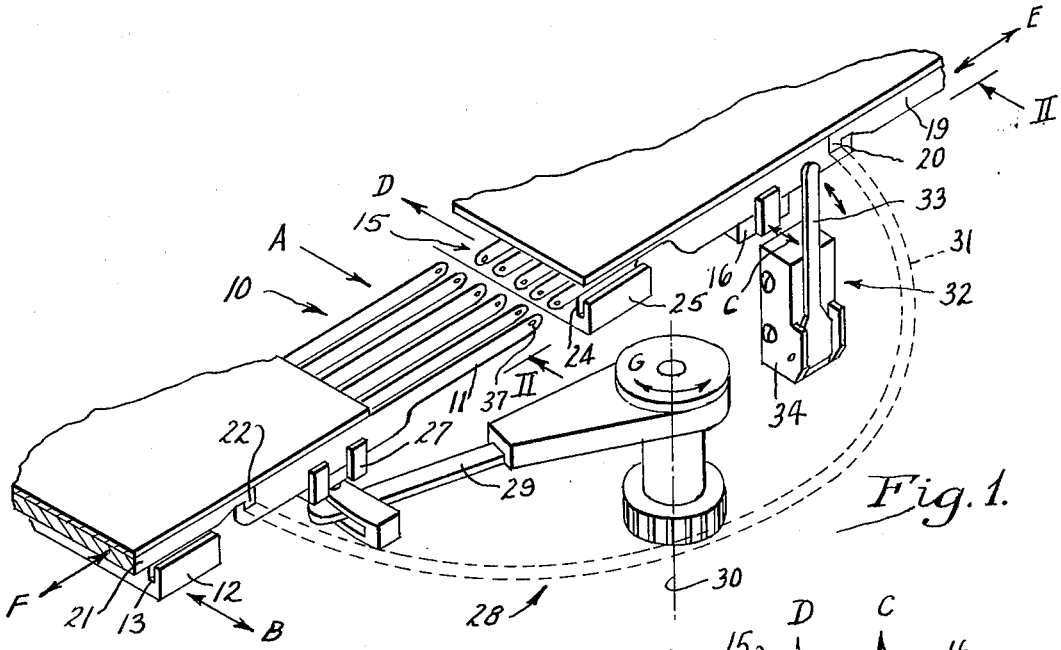
FIG. 1 is a partial perspective view of a heddle transfer stop motion apparatus according to this invention showing its relationship to other related apparatus.
Figure 3:
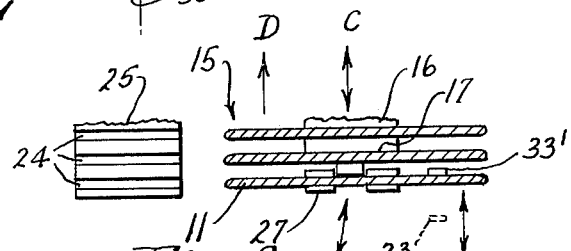
FIG. 3 is a section taken substantially along the line III—III in FIG. 2.
Figure 5:
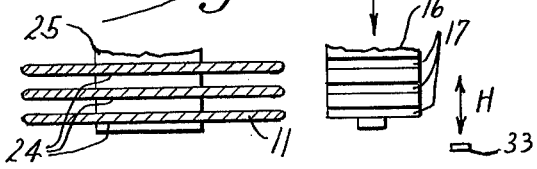
FIG. 5 is a section taken substantially along the line V—V in FIG. 4.
Figure 4:
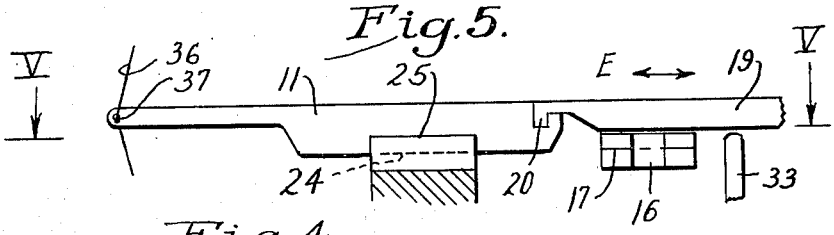
FIG. 4 is an elevation similar to FIG. 2, but with the components in another position.

As seen in FIG. 1 a weaving machine comprises a weftwise row 10 of heddles, such as 11, movable in a direction indicated by the arrow A by a heddle shifting bar 12, having spaced grooves 13 therein for reception of the heddles and reciprocable weftwise, as shown by arrow B. A shifting means of this type is disclosed and claimed in copending U.S. Pat. application Ser. No. 603,657, filed on Aug. 11, 1975, to which reference is made for a more complete description. A suitable heddle is described and claimed in a copending U.S. Pat. application Ser. No. 582,246, filed on May 30, 1975, to which reference is made for a more complete description. Another similar weftwise row 15 of heddles, such as 11, is adjacent and opposed to row 10. A heddle shifting bar 16, having spaced grooves 17 therein for reception of the heddles in row 15, is reciprocable weftwise, as illustrated by arrows C, to move the row 15 in opposite direction with respect to row 10, as indicated by arrow D. A heddle shedding bar 19 has a lip 20 engaging each of the heddles in row 15 and is reciprocable, as shown by arrows E, to move the engaged heddles longitudinally between extended and retracted positions. A similar heddle shedding bar 21, having a lip 22 engaging each of the heddles in row 10, is reciprocable, as shown by arrows F, to move the engaged heddles longitudinally between extended and retracted positions. As shown in FIG. 1 the heddles in row 10 are extended, while those in row 15 are retracted. When in retracted position the heddles occupy grooves 13, 17, as seen in FIG. 3. In extended position the heddles in row 15 occupy spaced passageways 24 in a stationary block 25 as seen in FIGS. 4 and 5. The heddles in row 10, when extended, with the exception of the leading heddle, occupy passageways in a similar stationary block (not visible). When a heddle assumes the leading position in row 10 it enters, when extended, a receptable 27 on a transfer mechanism 28, such as is disclosed and claimed in a copending U.S. Pat. application Ser. No. 620,332, filed on Oct. 7, 1975, to which reference is made for a more complete description. Another suitable transfer mechanism is disclosed and claimed in a copending U.S. Pat. application Ser. No. 603,756, filed on Aug. 11, 1975. As shown, the receptacle 27 is moved by an arm 29 oscillating about an axis 30, as shown by arrows G, to deliver the heddle in receptacle 27 from the extended leading position in row 10 to the retracted trailing position in row 15, the heddle being guided between said positions by a stationary curved track 31 (shown in dashed lines) engaging the heddle and aligned at its ends with the lips 22, 20 in the respective extended and retracted positions thereof. A detector 32, shown as comprising a lever 33 movable, as shown by arrows H, to operate a detector switch 34, is located at the trailing end of row 15 to detect the alignment (or, optionally, the misalignment) of the heddle delivered to the trailing end of row 15 in retracted position with the end passageway 24 in stationary block 25.

Figure 2:
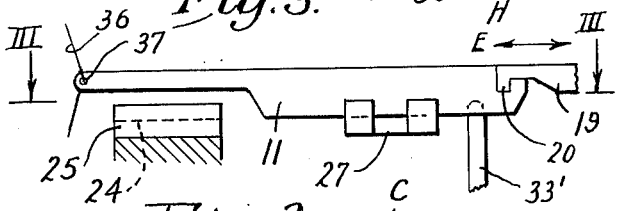
FIG. 2 is an elevation of the detector seen from line II—II of FIG. 1.

As seen in FIGS. 2, 3, the heddle 11 in receptacle 27 has just been transferred to the retracted position at the trailing end of row 15, so that a warp strand 36 passing through an eye 37 in the heddle is on the near side of a warp shed. The end of the lever occupied its free position 33 until it was engaged by heddle 11 and moved to the position 33'. When the heddle 11 is properly aligned with the end passageway 24 in block 25, the heddle has moved the lever 33 to trip the switch 34. Tripping of the switch at this time permits the shedding bar 19 to move the heddle longitudinally out of receptacle 27 into the end passageway 24 in block 25 and into extended position, as seen in FIGS. 4, 5, so that the warp strand 36 forms a portion of the far side of a warp shed. When the heddle is moved to extended position, it no longer engages the lever 33, permitting the end of the lever to again assume its free position, as seen in FIG. 5, and thereby permitting the switch 34 to resume its normal state.

Figure 6:
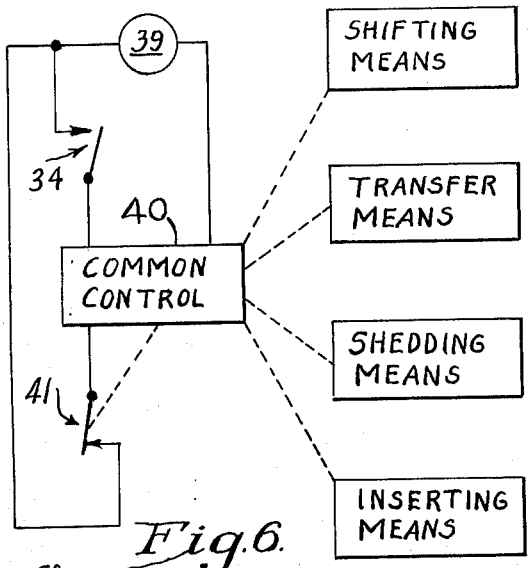
FIG. 6 is a schematic diagram of a control suitable for use in the stop motion apparatus.

FIG. 6 shows detector switch 34 controlling current between a voltage supply 39 and a common control 40, which in turn controls operation of a timing switch 41 connected in parallel with switch 34, so that one or both of the switches 34, 41 must be closed to permit continuous operation of the synchronized heddle shifting, heddle transfer, heddle shedding and weft inserting means in the weaving machine. The common control 40 acts to open switch 41 momentarily when the heddle has been transferred to the trailing end of row 15 to interrupt operation of the common control and the synchronized operations controlled thereby unless the detector switch 34 is closed.

Figure 7:
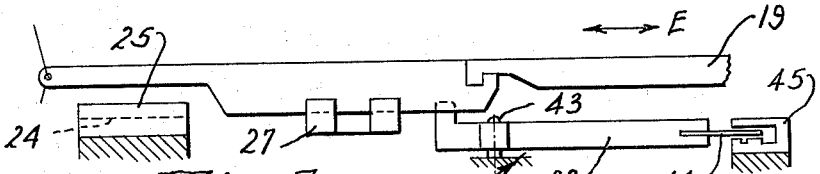
FIG. 7 is an elevation showing a solid state position sensor employed in a detector.

FIG. 7 shows an alternative construction in which lever 33 is pivoted about an axis 43 such that the motion of a vane 44 on the long end thereof is magnified as it is moved through a solid state position sensor 45, acting as a switch. Suitable position sensors comprise a proximity switch, a Hall sensor and magnet combination, an opto-coupler, or other devices accomplishing similar results. Solid state devices have the advantage of longer life than contact switches.

Figure 8:
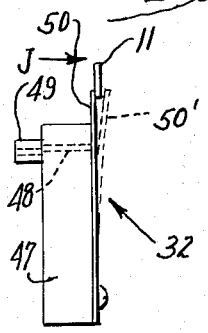
FIG. 8 is an elevation of a fluidic position sensor suitable for use as a detector.

FIG. 8 shows a fluidic position sensor comprising a body 47 having a hole 48, acting as a nozzle, therethrough, a fluidic inlet 49 in communication with the hole, and a flapper 50 biased to close the outlet end of hole 48 and so prevent the escape of fluid therefrom and maintain the fluidic pressure. The detector is so mounted in a fixed position adjacent the trailing end of row 15 that a flapper 11 transferred in the direction of arrow J to said trailing end engages the flapper and, when properly aligned with the end passageway 24, moves the flapper to a dashed line position 50' away from the end of hole 48 so that fluid may escape therefrom and so lower the fluidic pressure. The resulting change in pressure may be employed directly to deenergize the common control 40, or it may be first converted to an electrical or other signal.

OPERATION

When the heddles in row 10 are in retracted position in grooves 13, the heddle shifting bar 12, under control of the shifting means, advances the heddles in the direction of arrow A toward the leading end visible in FIG. 1. The heddle shedding bar 21, under control of the shedding means, then moves the heddles in row 10 to extended position with the leading heddle 11 entering receptacle 27, as shown in FIG. 1. The heddles in row 15 are retracted with the trailing heddle in the end groove 17 of heddle shifting bar 16, as shown in FIG. 1. The heddle shifting bar 16, under control of the shifting means, then moves to advance the heddles in the direction of arrow D. The receptacle 27 with the leading heddle 11 from row 10 therein is moved, under control of the transfer means, by counterclockwise rotation of arm 29, as seen in FIG. 1, to a position adjacent the end of heddle shifting bar 16, as shown in FIG. 3. The heddle 11 is thus transferred from an extended leading position at the end of row 10, as seen in FIG. 1, to a retracted trailing position at the end of row 15, as seen in FIGS. 2, 3. In doing so the heddle is continuously engaged in succession by lip 22, curved track 31 and lip 20 such that the heddle is rotated substantially around its eye 37 in order to prevent production of slack in the warp strand 36 guided thereby, and assuring that the heddle is engaged by the heddle shedding means 19 as it enters row 15. When the transfer is properly made, the heddle transferred to the trailing position is properly aligned with the end passageway 24 in stationary block 25 and trips a detector 32, enabling heddle shedding bar 19, under control of the shedding means, to move the heddle longitudinally into the passageway, as seen in FIGS. 4, 5. If the detector is not tripped, operation of the weaving machine is interrupted until the heddle is properly aligned.

As shown, the detector 32 comprises a lever 33 which is engaged and moved by the heddle being transferred as it approaches row 15 until the lever trips a precision switch 34 when the heddle is in the proper aligned position with respect to the end passageway 24. As shown in FIG. 6, the detector switch 34 is normally open, closing when it is tripped upon detection of the proper aligned position of the heddle to complete a circuit between a voltage supply 39 and a common control 40. A normally closed timing switch 41, in parallel with detector switch 34, is momentarily opened by the common control when the heddle is supposed to be in proper alignment with the passageway 24, so that, unless the detector switch is closed during such momentary opening of the timing switch, the common control 40 is deenergized, stopping the shifting, transfer, shedding and weft inserting means until the misalignment or other problem can be corrected.

Assuming that alignment of heddle 11 with the end passageway 24 is proper, the shedding bar 19, under control of the shedding means moves the heddle from retracted position, as shown in FIGS. 2, 3, to extended position, as shown in FIGS. 4, 5. The receptacle 27 is then moved by arm 29, under control of the transfer means, back to the position shown in FIG. 1. The heddle shifting bar 16, under control of the shifting means, moves toward the trailing end of row 15 so that the end groove 17 is aligned with the heddle 11 in end passageway 24. The heddle shedding bar, under control of the shedding means, moves the heddle longitudinally from extended position in passageway 24 to retracted position in groove 17, as shown in FIG. 1, after which the cycle is repeated with the new leading heddle in row 10.

When a single set (two opposed rows) of heddles are employed, the heddles in the opposed rows are extended simultaneously and retracted simultaneously, the heddles in the two rows being staggered so that they do not interfere when both are extended. The positions of the rows 10, 15, as shown in FIG. 1, are those occupied at different times coresponding to the beginning and end of the heddle transfer operation and would not ordinarily be occupied concurrently. They are shown as they are only to simplify the description. Both rows of heddles would be extended at the beginning of heddle transfer and both would be retracted at the end of the heddle transfer. Weft insertion occurs when both rows of heddles are extended and when both rows of heddles are retracted, in well known manner. The mechanism for accomplishing weft insertion plays no part in the stop motion apparatus, so it is not shown or described.

CONCLUSIONS

The copending applications referenced in the description are owned in common with this application. They are incorporated herein to the extent necessary for a complete understanding of this invention.

Although the invention has been described in terms of triaxial weaving, it will be recognized that it may be applied to any weaving machine employing a transfer of heddles from a leading end of one row of a trailing end of another row.

Those skilled in the art will recognize many equivalents in apparatus and circuitry that may be employed in accomplishing the desired results. The described embodiment is merely illustrative and not for the purpose of limiting the scope of the claims.

I claim:

1. In a weaving machine wherein a heddle is transferred laterally to a trailing end of a weftwise row of laterally shifting heddles and then moved longitudinally in a fixed path to position a warp strand guided thereby at a predetermined location in a warp shed, apparatus for detecting improper positioning of said heddle at the trailing end of said row of heddles, said apparatus comprising a fixed passageway at the trailing end for receiving and guiding longitudinal movement of said heddle into an extended heddle shedding position, transfer means for moving the heddle laterally into alignment with said passageway, and a detector for sensing a predetermined lateral position of said heddle at which the heddle is in substantial alignment with said passageway.

2. Apparatus according to claim 1 wherein said detector comprises a switch.

3. Apparatus according to claim 2 further comprising a member movable to operate said switch in response to engagement by the heddle in substantial alignment with said passageway.

4. Apparatus according to claim 1 wherein said detector comprises a solid state position sensing device.

5. Apparatus according to claim 1 wherein said detector comprises an opto-coupler.

6. Apparatus according to claim 1 wherein said detector comprises a Hall sensor.

7. Apparatus according to claim 1 wherein said detector comprises a proximity switch.

8. Apparatus according to claim 1 wherein said detector comprises a fluidic position sensor.

9. Apparatus according to claim 1 further comprising shedding means for moving said heddle longitudinally, and means enabling said shedding means to move the heddle into said passageway in response to sensing by the detector of said heddle in substantial alignment with the passageway.

10. Apparatus according to claim 1 further comprising shedding means for moving said heddle longitudinally, and means preventing shedding means for moving the heddle toward said passageway in absence of sensing by the detector of said heddle in substantial alignment with the passageway.

11. Apparatus according to claim 1 further comprising means for interrupting the essential weaving operations of the machine, said detector enabling the interrupting means to stop said essential operations in response to sensed absence of alignment of the heddle with said passageway.

12. Apparatus according to claim 1 further comprising means for controlling the essential weaving operations of the machine, and timing means controlled by said controlling means to interrupt energization of said controlling means upon completion of transfer of the heddle, said detector enabled in response to substantial alignment of said heddle with the passageway to prevent interruption of energization of said controlling means.

13. In a weaving machine a heddle, a weftwise row of heddles, means for transferring said heddle laterally to the trailing end of said row of heddles, shedding means for extending said heddle longitudinally to position a warp strand guided thereby into a predetermined location in a warp shed, a stationary passageway adjacent the trailing end of said row of heddles, and means for detecting substantial alignment of said heddle with said passageway after said heddle has been transferred to the trailing end of said row of heddles, said detecting means preventing extension of the heddle by said shedding means in absence of said alignment.

14. A method for preventing malfunction of a weaving machine, said method comprising the steps of transferring a heddle laterally to a position at the trailing end of a weftwise row of heddles moving laterally, sensing absence of alignment of said transferred heddle with a stationary passageway for receiving and guiding said heddle in longitudinal movement from the position, and preventing said longitudinal movement of the heddle in response to said sensed absence of alignment.

15. A method for preventing malfunction of a weaving machine, said method comprising the steps of transferring a heddle laterally to a position at the trailing end of a weftwise row of heddles moving laterally, sensing absence of alignment of said transferred heddle with a stationary passageway for receiving and guiding said heddle in longitudinal movement from the position, and interrupting synchronized weaving operations of said machine in response to the sensed absence of alignment.

* * * * *

UNITED STATES PATENT OFFICE

CERTIFICATE OF CORRECTION

Patent No. 3,998,250 Dated December 21, 1976

Inventor(s) Franklin L. Townsend

It is certified that error appears in the above-identified patent and that said Letters Patent are hereby corrected as shown below:

In column 6, line 6, after "preventing" insert --the--, and change "for" to --from--.

Signed and Sealed this

Third Day of May 1977

[SEAL]

*Attest:*

RUTH C. MASON
*Attesting Officer*

C. MARSHALL DANN
*Commissioner of Patents and Trademarks*